United States Patent [19]

Ueda et al.

[11] Patent Number: 4,934,683

[45] Date of Patent: Jun. 19, 1990

[54] AUTOMATIC ORIGINAL CONVEYING APPARATUS

[75] Inventors: Noriyoshi Ueda, Yokohama; Takeshi Honjo, Kawasaki; Toshiaki Murayama, Tokyo; Masaru Shinoda, Yamanashi, all of Japan

[73] Assignees: Canon Kabushiki Kaisha; Nippon Seimitsu Kogyo Kabushiki Kaisha, both of Tokyo, Japan

[21] Appl. No.: 194,272

[22] Filed: May 16, 1988

[30] Foreign Application Priority Data

May 18, 1987 [JP] Japan ..... 62-121806

[51] Int. Cl.[5] ..... B65H 7/14

[52] U.S. Cl. ..... 271/3.1; 271/176; 271/199

[58] Field of Search ..... 271/258, 259, 265, 176, 271/199, 3.1

[56] References Cited

U.S. PATENT DOCUMENTS

| | | | |
|---|---|---|---|
| 4,076,408 | 2/1978 | Reid | 271/258 X |
| 4,469,320 | 9/1984 | Wenthe | 271/3.1 |
| 4,480,824 | 11/1984 | Acquaviva | 271/258 X |
| 4,579,327 | 4/1986 | Furuichi | 271/3.1 |
| 4,589,645 | 5/1986 | Tracy | 271/3.1 |
| 4,723,772 | 9/1988 | Honjo et al. | 271/3.1 |

*Primary Examiner*—Richard A. Schacher

*Attorney, Agent, or Firm*—Fitzpatrick, Cella, Harper & Scinto

[57] ABSTRACT

An automatic original conveying apparatus in which originals loaded on an original stacking unit are conveyed to a predetermined position one by one. Abnormal stacking of the original on the original stacking unit is detected, and continuation of operation is prohibited in response to the detection of such abnormal stacking of the originals.

10 Claims, 11 Drawing Sheets

AUTOMATIC ORIGINAL CONVEYING APPARATUS

BACKGROUND OF THE INVENTION

1. Field of the Invention

The present invention relates to an automatic original conveying apparatus for use in an image forming apparatus such as a copying machine or a laser beam printer, and more particularly to an automatic recycling original conveying apparatus for recycling the original documents between an original stacker and an exposure position of the image forming apparatus.

2. Related Background Art

Conventional automatic recycling original conveying apparatus are generally so constructed as to feed the original documents stacked on an original stacker one by one from the lowermost one to the exposure position of an image forming apparatus such as a copying machine, and, after the exposure, return said original documents onto said original stacker, and repeat the above-explained operation by a number of cycles corresponding to the desired number of copies, wherein a cycle means the feeding operations of a number corresponding to the number of original documents in the stack.

In such automatic recycling original conveying apparatus in which the original documents stacked on the original stacker are separated in succession from the lowermost one, the separating condition varies significantly by the number of stacked original documents, and the separation becomes more difficult as the number of stacked original documents becomes larger. Consequently for achieving secure separation there is an upper limit of the number of stacked originals, and defective separation may occur if said upper limit is exceeded.

Also the original documents returned to the stacker need to be precisely aligned in order to be fed again. For this reason the original documents have to be securely aligned in the direction of width, and the documents may show positional error in the direction of width or may proceed in skewed position unless the operator sets a lateral defining plate in an appropriate position corresponding to the size of the original documents.

Also the two-folded or Z-folded originals have to be unfolded by the operator before setting on the stacker since such originals cannot be aligned satisfactorily when they are returned to the original stacker, but such originals may cause defective refeeding if they are not properly unfolded by the operator.

SUMMARY OF THE INVENTION

In consideration of the foregoing, the object of the present invention is to provide an automatic original conveying apparatus capable of stable and reliable operation without defective feeding of the original documents.

The above-mentioned object can be achieved, according to the present invention, by an apparatus which is provided, as shown in FIG. 1, with abnormal stacking detection means for detecting abnormal stacking of the original documents tacked on the original stacker; and work continuation preventing means for discontinuing the operation in response to the detection of abnormal stacking by said detection means.

When said detection means detects abnormal stacking, such as excessive stacking of original documents, when the original documents are stacked on the original stacker, the operation is discontinued in response to said detection.

It is therefore rendered possible to eliminate in advance the cause of troubles in the transportation of the originals, such as defective separation of the original documents.

BRIEF DESCRIPTION OF THE DRAWINGS

FIGS. 9 to 15 are flow charts of the function of an embodiment wherein FIG. 9 shows the outline of the entire function; FIG. 10 shows a recycle lever check process 1; FIG. 11 shows a weight check process; FIG. 12 shows a width alignment check process; FIG. 13 shows an alarm process; FIG. 14 shows a recycle lever check process 2; and FIG. 15 shows a jam process.

DESCRIPTION OF THE PREFERRED EMBODIMENTS

Now the present invention will be clarified by embodiments thereof shown in the attached drawings.

Figure 2:
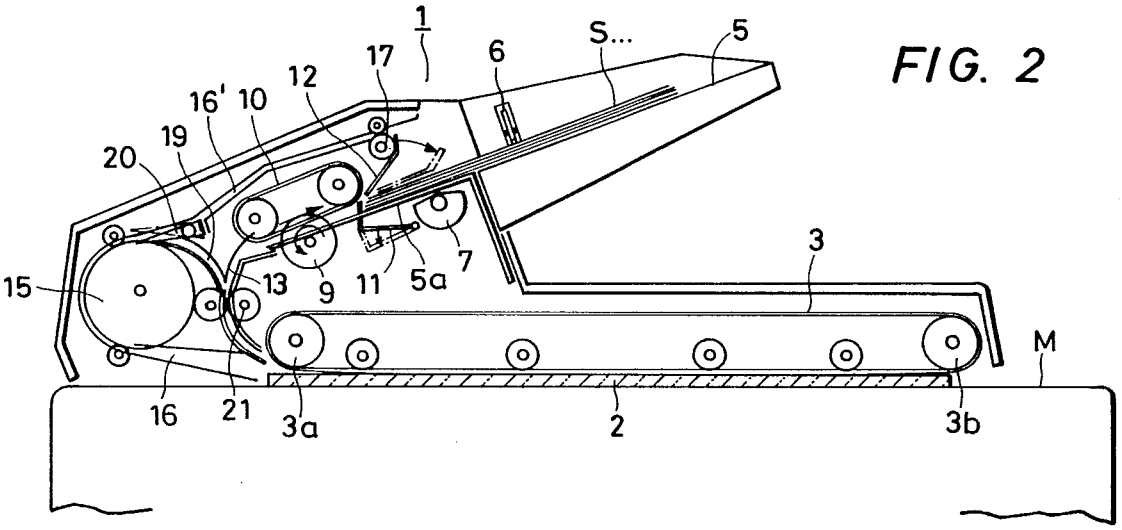
FIG. 2 is an automatic original conveying apparatus embodying the present invention.

An automatic original conveying apparatus 1 is provided, as shown in FIG. 2, on a platen 2 of a copying machine M, and is equipped with a conveyor belt 3 positioned between a driving roller 3*a* and an idler roller 3*b*. Above said conveyor belt 3, there is provided an original stacker 5 constituting an original stacking unit and capable of supporting a stack of plural originals S. On said stacker 5 there is provided a recycle lever 6, which separates the stacked originals into unprocessed ones and already processed ones. At the base 5*a* of the stacker 5 there is provided a sheet feed roller 7 of a semi-circular section. At the downstream side of said roller 7 there is provided a separating unit composed of a transport roller 9 and a separating belt 10. The stack S of the originals placed on the stacker 5 is moved toward the separating unit 9, 10 by the feed roller 7, and said originals are separated and fed one by one from the lowermost one, by means of the transport roller 9 rotated in the direction of original feeding and the separating belt 10 rotated in opposite direction. Between the feed roller 7 and the separating unit 9, 10 there is provided a sheet stopper 11, which is in the solid-lines position to define the leading ends of the originals at the setting thereof, but is moved to the broken-lined position by the energization of a stopper solenoid at the original feeding operation. From the downstream portion of said separating unit 9, 10 to the above-mentioned conveyor belt 3 there is provided a curved sheet path 13, whereby the original S supplied from the separating unit 9, 10 is transported along said sheet path 13 to the gap between the conveyor belt 3 and the platen 2 and delivered to a predetermined position on said platen 2. In the vicinity of said sheet path there is provided an inverting roller 15, and a discharge path 16 extends from said conveyor belt 3, along the periphery of said reversing roller 15, to the original stacker 5. Consequently the original S placed in the predetermined position on the platen 2 is again transported, by the reverse rotation of the belt 3, along said discharge path 16, then further guided by the roller 15 and a discharge roller 17 positioned at the downstream end of a discharge path 16', and discharged on the top of the stack S of originals on the original stacker 5. In addition an inverting path 19 branches from the discharge path 16 at the top of the inverting roller 15, and joins the feed path 13. At the branching portion of said inverting path 19 and the discharge path 16' there is provided a flapper 20 for switching the transport path. Said flapper 20 is in the solid-lined position in the original discharging to guide the original toward the original stacker 5, but, in the inversion of the original, is moved to the broken-lined position by the energization of a flapper solenoid to guide the original toward the platen through the inverting path 19. The original is transported again to the platen 2 by the forward rotation of the belt 3. At the downstream side of the joining portion of the feed path 13 and the inverting path 19 there are provided transport rollers 21 for forwarding the original S, fed through the feed path 13 or the inverting path 19, toward the platen 2.

In the following there will be explained the original transporting operation of the automatic original conveying apparatus 1.

At first the operator sets the stack S of originals to be copied on the original stacker 5. Then the operator enters necessary operation modes (number of copies, image magnification, image density etc.) from an operation panel of the copying machine M, and turns on a copy start key, whereby the stack of originals is fed to the separating unit 9, 10 by the rotation of the feed roller 7. The originals are separated and fed one by one from the lowermost one by the separating unit 9, 10, and each original is delivered through the feed path 13 and placed on the platen 2 by the belt 3, for image reading. Thereafter the original S is discharged through the discharge path 16, 16' by the reverse rotation of the belt 3, and stacked by the discharge roller 17 onto the top of the original stack S on the stacker 5.

Figures 3A, 3B, 3C, 3D, 3E:
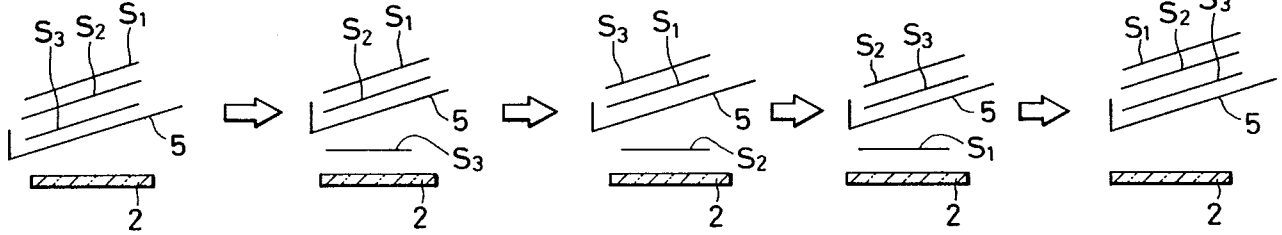
FIGS. 3A to 3E and 4A to 4H explain the original conveying operation, respectively of one-sided and two-sided originals.

FIG. 3 illustrates the flow of three one-sided originals $S_1$, $S_2$, $S_3$ of the stack S. The originals are fed and restacked from the lowermost original $S_3$ and a set of operation is completed by the steps (A) to (E) shown in FIG. 3. A desired number of copies can be obtained by repeating the above-explained operation by a necessary number of times.

Figures 4A, 4B, 4C, 4D, 4E, 4F, 4G, 4H:
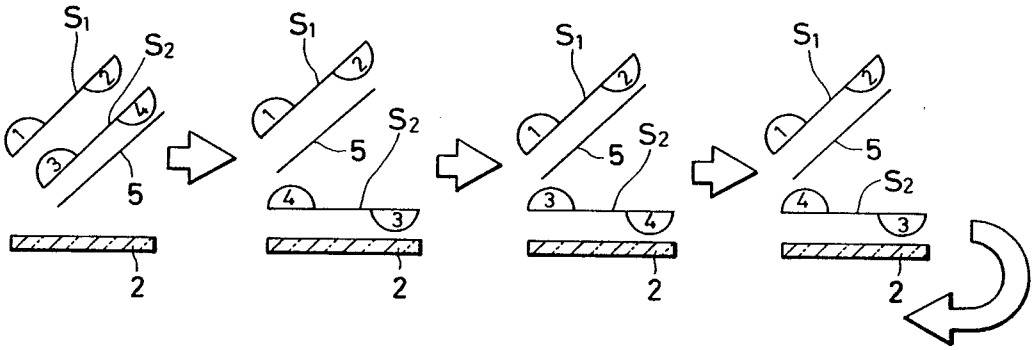

FIG. 4 illustrates the flow of three two-sided originals $S_1$, $S_2$ of the stack. At first the lower original $S_2$ is fed and placed on the platen 2 with a face (3) downwards, but said face is not copied in order to obtain a proper sequence of pages. The copying operation is started after the original is inverted through the inverting path 19 and placed again on the platen 2 with the reverse face (4) downwards. Then the original is again inverted through the inverting path 19 and placed again on the platen 2 with the face (3) downward for copying said face, and the original is thereafter discharged in the original state onto the top of the originals on the stacker 5. In the same manner the faces (2) and (1) of next original $S_1$ are copied in this order, and said original is discharged on the stacker 5. In this manner the images of two-sided originals of a set are processed by a cycle of the steps shown in FIG. 4, and a desired number of processings can be achieved by repeating said cycle of a necessary number of times.

The automatic original conveying apparatus 1 is further provided with abnormal stacking detecting means for detecting abnormal stacking of the originals on the stacker 5. In the following there will be explained devices or means constituting said detecting means.

Figure 1:
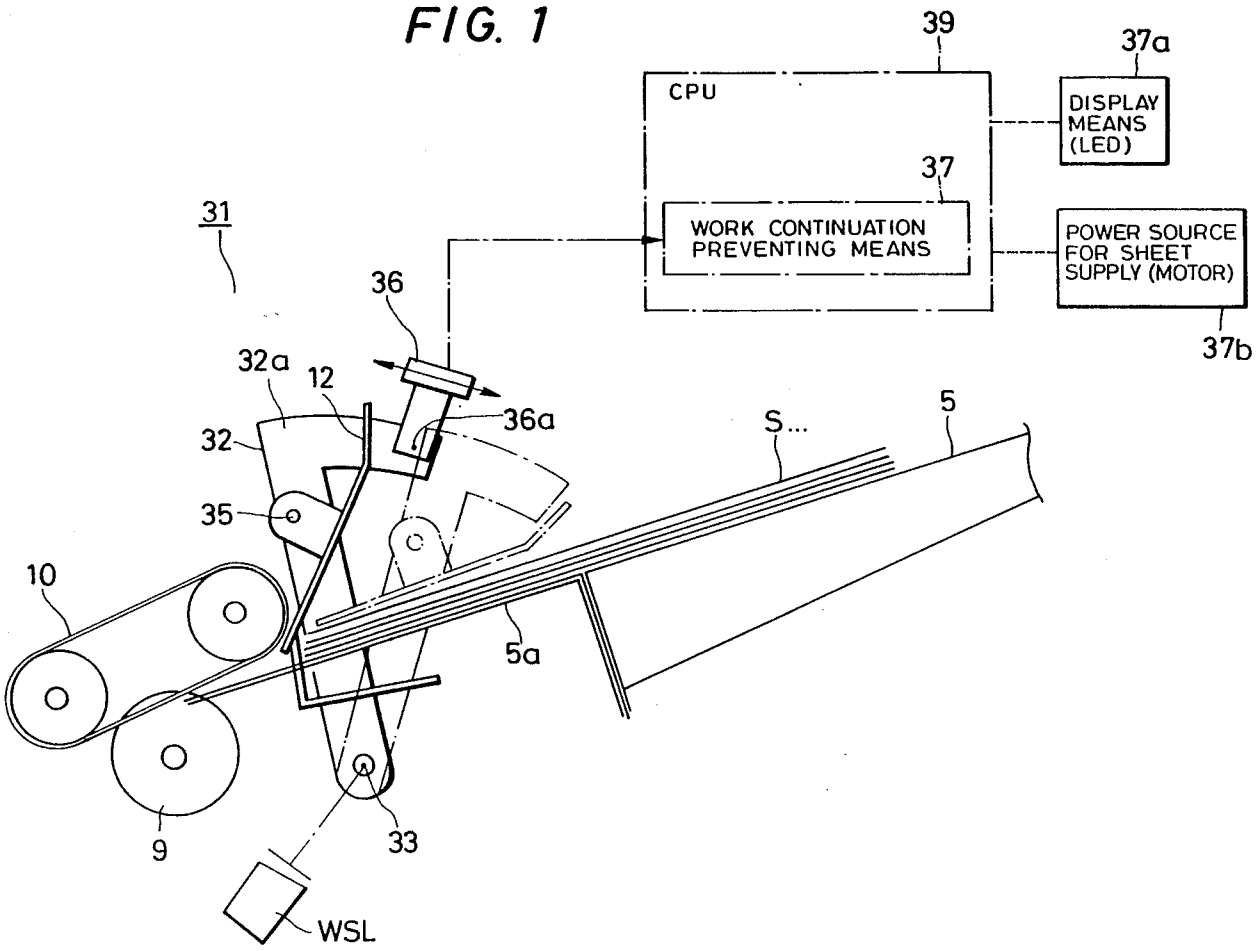
FIG. 1 is a lateral view of means for detecting the excessive stacking of originals, in an embodiment of the present invention.

At the base portion 5*a* of the original stacker 5 there is provided an excessive stacking detecting device 31, which is equipped, as shown in FIG. 1, with a weight 12 for pressing the stack S of originals on the stacker 5 from the top thereby ensuring the feeding function of the feed roller 7. Said weight 12 is rotatably supported, by means of a pin 35, by support arms 32 rotatably supported by a shaft 33 on the side plates of the automatic conveying apparatus 1. At the end 32*a* of said support arm 32 there is provided an optical weight sensor 36 having a light path 36*a*. After the stack S of originals is set on the stacker 5 and the copy start key is actuated, said weight 12 descends together with the support arms 32 to the dash and dot-lined position by the function of a weight solenoid WSL, thereby pressing said stack S.

In the present invention, there is defined in advance a limit stack thickness for ensuring sheet separation by the separating unit 9, 10. Thus, when the weight 12 presses the stack S of originals, an excessive stacking is identified if the light path of the weight sensor 36 is intercepted by the support arm 32. On the other hand the stacking is identified as within the limit if the support arm 32 is in the dash and dot-lined position and is not detected by the weight sensor 36. In this manner the excessive stacking can be identified before the start of original feeding operation.

The control unit 39 is equipped with work continuation preventing means 37 which, in response to the detection of abnormal stacking such as excessive stacking, provides an alarm display on display means 37*a* composed for example of light-emitting diodes, and prohibiting the continuation of succeeding operations, thereby interrupting the succeeding operations such as original feeding.

Said interruption may be achieved by stopping a motor 37*b* for driving the feed roller 7 etc. or by disconnecting a clutch for transmitting the rotation of said motor 37*b*.

In the following there will be explained an excessive stacking detecting device utilizing a recycle lever, instead of the above-explained detecting device 31.

Figure 5:
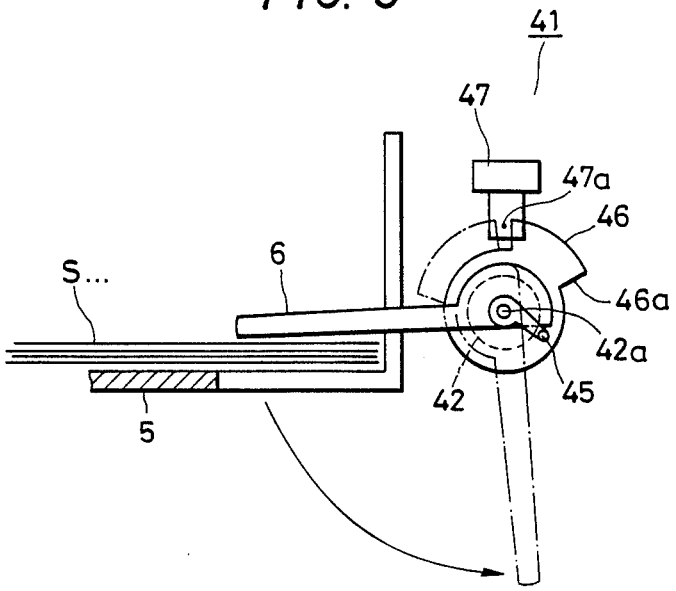
FIG. 5 is a front view of another means for detecting excessive original stacking.

FIG. 5 is a detailed front view of an excessive stacking detecting device utilizing a recycle lever 6 to be positioned on the original stacker 5.

Said detecting device 41 is equipped, as shown in FIG. 5, with a recycle motor 42 and a recycle lever 6 rotatably supported by a shaft 42*a* of said motor 42. Said motor shaft 42*a* supports a lever driving pin 45 and a flag 46 for integral rotation with said recycle lever 6, and, opposed to said flag 46 there is provided an optical recycle sensor 47 having an optical path 47*a* for detecting the position of said flag 46.

When the stack S of originals is set on the original stacker 5 and the copy start key is actuated, the recycle motor 42 is energized to rotate the recycle lever 6 through the lever driving pin 45, thereby pressing the top of said stack S.

When the recycle lever 6 presses the stack S, the stack is identified as excessive or within the limit respectively if the recycle sensor 47 detects the flag 46 or not.

Also when the last original of the stack S is fed, the recycle lever 6 drops to the dash and dot-lined position by the weight thereof, whereby the recycle sensor 47 detects an end face 46*a* of the flag 46 moving together with said recycle lever 6, thus identifying the end of a cycle of the stack S of originals.

Now reference is made to FIG. 6 for explaining a defective lateral alignment detecting device for preventing lateral misalignment and skewed feeding of originals resulting from defective setting of the originals on the original stacker 5.

Figure 6A:
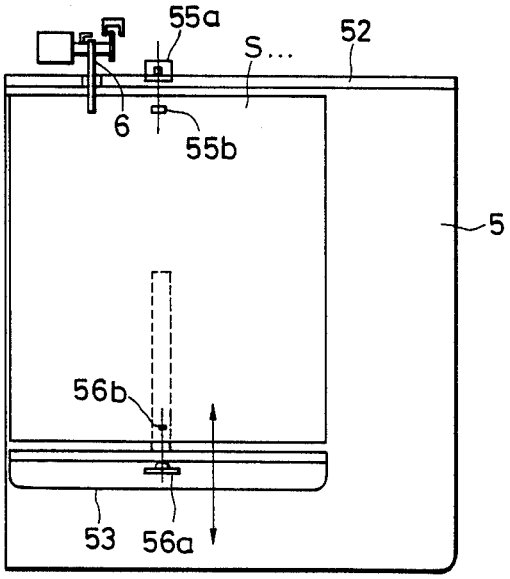
FIGS. 6A and 6B are a plan view and a lateral cross-sectional view of a device for detecting defective lateral alignment.
Figure 6B:
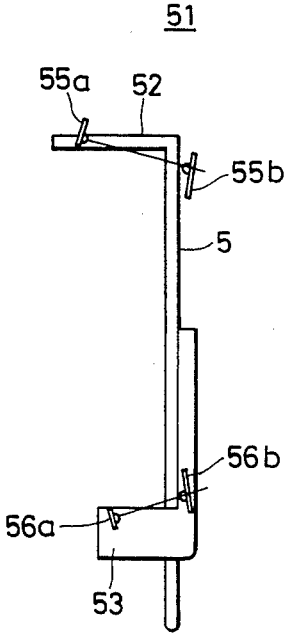
Figure 7:
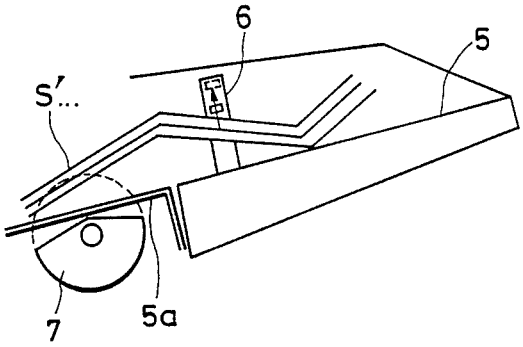
FIG. 7 is a lateral view of an original stacker on which folded originals are stacked.

FIGS. 6A and 6B are respectively a plan view and a transversal cross-sectional view of said original stacker 5.

Said detecting device 51 is equipped with a rear width defining sensor 55 and a front width defining sensor 56 respectively positioned on a reference guide member 52 formed on the stacker 5 as a positional reference for the setting of the stack S and on a width defining plate 53 which is slidable according to the original size. Said sensors 55, 56 are composed of light emitting elements 55*a*, 56*a* and light receiving elements 55*b*, 56*b*, and are adapted to detect the original at positions which are several millimeters distant from original-contacting faces of said reference guide member 52 and said width defining plate 53. Consequently the sensor 55 detects the defective setting of the original stack S unless said stack S is securely maintained in contact with the reference guide member 52. Also the sensor 56 detects defective setting of the width defining plate 53 unless it is set in a proper position for the original size. Stated differently, the sensor 56*a*, 56*b* is not intercepted by the originals if the plate 53 is not in the proper position.

It is therefore rendered possible to detect defective setting of the stack S of originals or defective placement of the width defining plate 53 by the operator before the start of original feeding, and also to prevent defective alignment of the originals on the stacker 5 when said originals are discharged thereon.

In the following there will be explained the detection, by means of the recycle lever 6, of defective setting of the original stack S at the above-mentioned reference guide member 52.

As shown in FIGS. 5 and 6, the end portion of said recycle lever 6 presses the original stack S at a predetermined distance from the reference guide member 52. Consequently, if the stack S is set with a certain gap to the reference guide member 52, the recycle lever 6 is not stopped by said stack but makes a rotation when the copy start key is actuated. Thus the recycle sensor 47 detects the flag 46 immediately after the start of said rotation of the recycle lever 6, thus identifying that the original stack S is not properly set at the reference guide member 52.

In the following there will be explained the method of detecting defectively unfolded originals, for preventing defective stacking in the two folded or Z-folded originals.

If folded originals S' which have not been satisfactorily unfolded, are stacked on the stacker 5, the recycle lever 6 pressing said originals S' bounces and causes a movement in the course of feeding of said originals S'. The defective unfolding of said folded originals can therefore be detected by inspecting the movement of the recycle lever 6 in the course of feeding of said originals S'.

This method can detect not only the folded originals but also significantly curled originals so that it can prevent the defective alignment when the originals are discharged onto the original stacker 5.

Figure 8:
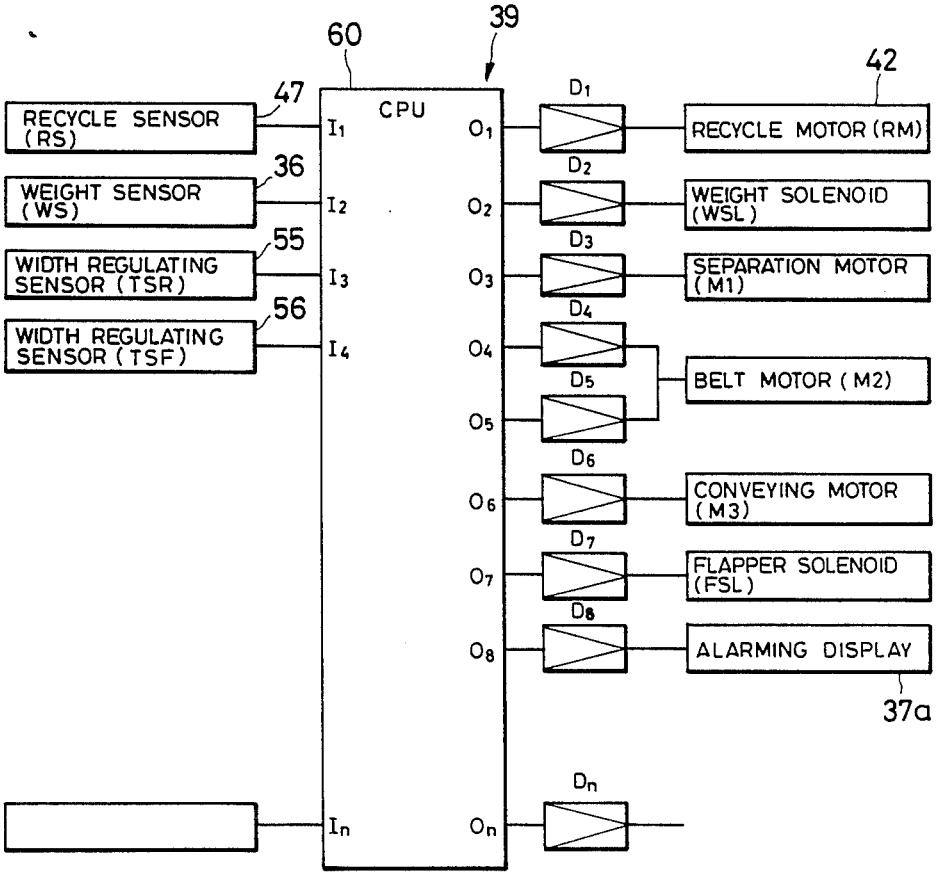
FIG. 8 is a block diagram of a control circuit.

Now reference is made to FIG. 8 for explaining the control circuit in the above-mentioned control unit 39.

FIG. 8 is a block diagram of said control circuit employing an already known one-chip microcomputer (CPU) 60 incorporating ROM, RAM, etc. and receiving the signals from various sensors through input ports $I_1$–$I_n$ of said microcomputer.

Output ports $O_1$–$O_n$ of said microcomputer are connected to various loads through drivers $D_1$–$D_n$.

Input port $I_1$ is connected to the recycle sensor 47 for detecting the flag 46 connected to the recycle lever 6; input port $I_2$ to the weight sensor 36 for detecting the support arm 32; input port $I_3$ to the width defining sensor 55 for detecting whether the originals are placed in contact with the rear end of the original stacker; and input port $I_4$ to the width defining sensor 56 for detecting whether the width defining plate 53 is set at a proper position to the originals.

Output port $O_1$ is connected to the recycle motor 42 for driving the recycle lever 6; output port $O_2$ to the weight solenoid for driving the weight 12; and output port $O_3$ to the alarm LED 37*a* for indicating abnormal stacking.

Other output ports are connected to the components relating to the sheet feeding, but these will not be explained as they are not directly related to the present invention.

Now there will be given an explanation on the function of the present embodiment, while making reference to flow charts shown in FIGS. 9 to 15.

Figure 9:
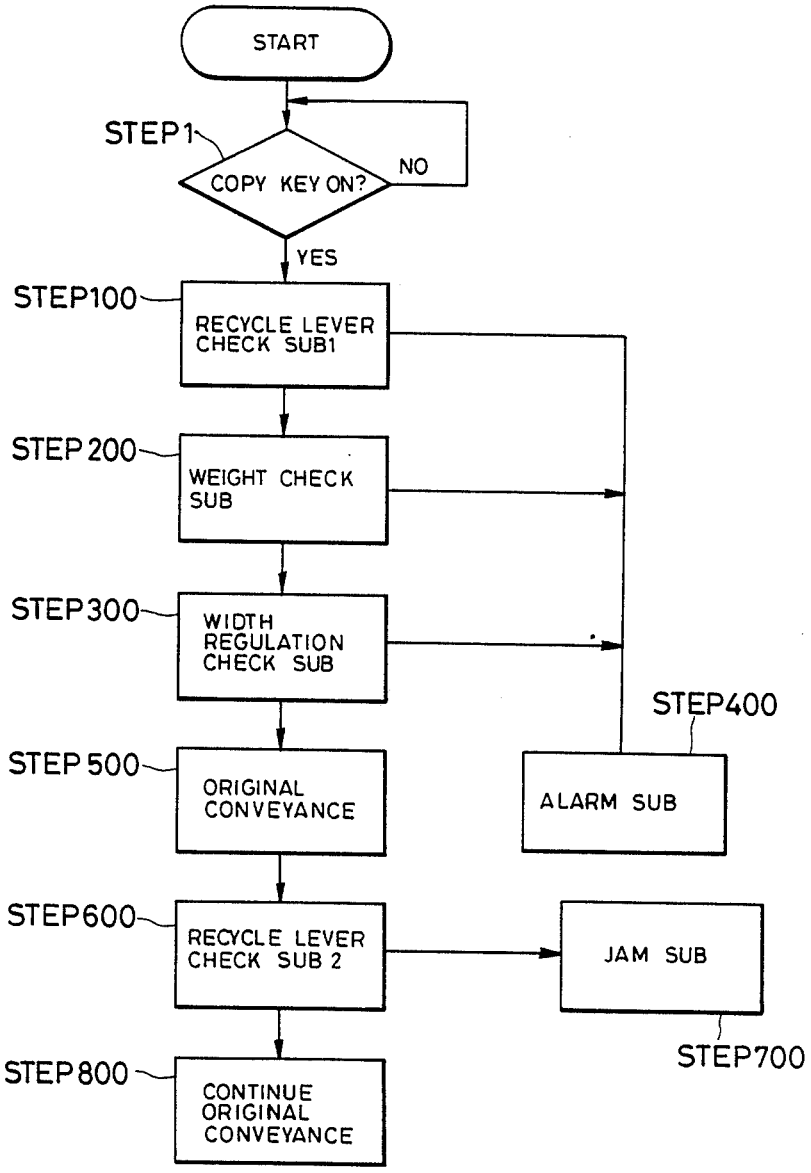

FIG. 9 is a flow chart showing the outline of the control sequence, which is initiated by the actuation of the copy start key (step 1). It then undergoes the sequences of checking abnormal stacking, such as a recycle lever check sequence 1 (step 100), a weight check sequence (step 200) and a width defining check sequence (step 300) to be explained later, and enables the original feeding (step 500) only after passing these check sequences.

Stated differently, the function of the automatic original conveying apparatus 1 is enabled only when the originals within the stacking limit are set in the proper position on the original stacker 5 and the width defining plate 53 is set at a proper position with respect to the originals.

After the original feeding (step 500), there is executed a check sequence for Z-folded or curled originals (step 600), and the original feeding is continued (step 800).

On the other hand, if an abnormal state is detected in the above-mentioned recycle lever check sequence 1 (step 100), weight check sequence (step 200) or width defining check sequence (step 300), the program proceeds to an alarm sequence (step 400) to prohibit the continuation of operation.

Also if an abnormal state is detected in the recycle lever check sequence 2 (step 600), the program proceeds to a jam sequence (step 700) to interrupt the operation.

These sequences will be explained in the following.

Figure 10:
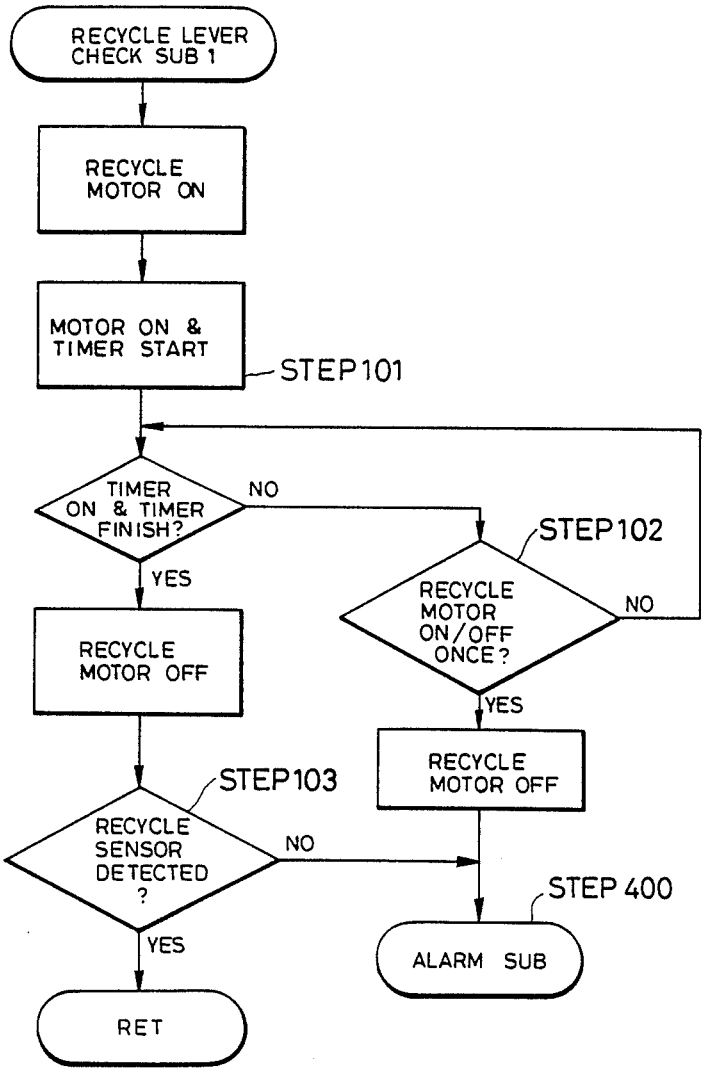

In the recycle lever check sequence 1 (step 100), as shown in FIG. 10, a motor-on timer is started simultaneously with the activation of the recycle motor 42

(step 101). Said motor-on timer is preset to a time, longer than the time required by the recycle lever 6 to reach the top of the original stack, so that the recycle lever 6 becomes still on the stack within said preset time even if the lever is bounced on the stack.

Thus, if the recycle sensor 47 is turned on and off before said motor-on sensor expires, there is identified the non-stopped rotation of the recycle lever resulting from defective stacking of originals explained before, and the program proceeds to the alarm sequence to be explained later (step 102).

After the expiration of said motor-on timer the recycle motor is deactivated. If the recycle sensor 47 does not detect the flag 46 in this state, an excessive stacking of originals is identified as explained before, and the program also proceeds to the alarm sequence (step 103).

If neither the step 102 nor 103 is executed, namely if the recycle sensor 47 detects the flag 46 upon expiration of the motor-on timer, the stacking is identified within the limit and the program proceeds to the next sequence.

Figure 11:
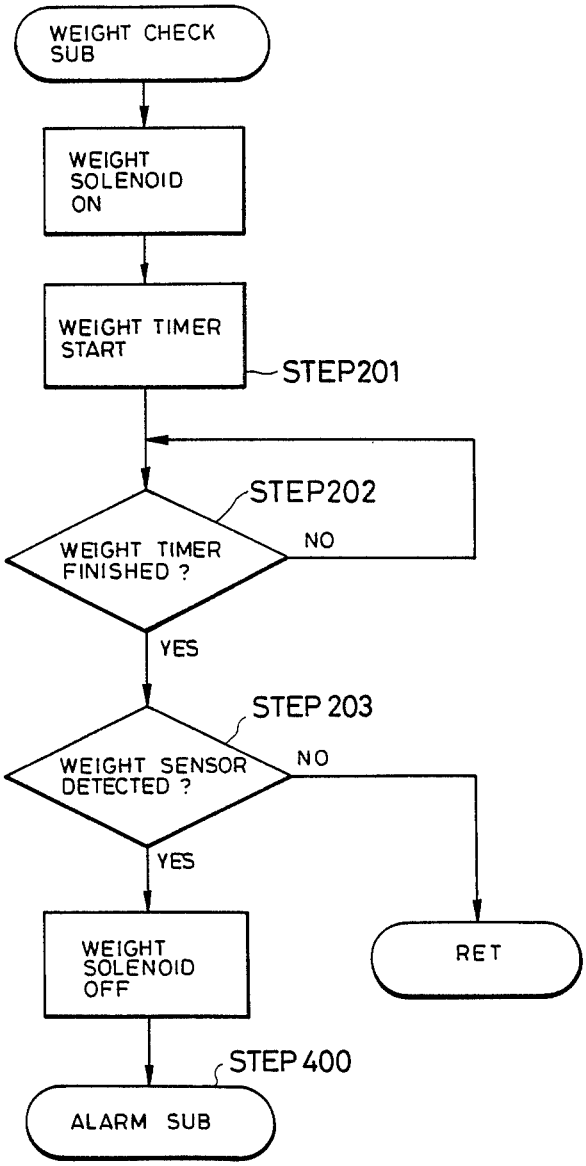

In the weight check sequence (step 200) shown in FIG. 11, the weight solenoid is energized to lower the weight 12 together with the support arms 32, and a weight timer is started (step 201).

Said weight timer is preset to a time required for complete pressing of the originals, and the program awaits the expiration of said timer (step 202). Upon expiration it is discriminated whether the weight sensor 36 detects the support arms 32. If said arms are detected, there is identified the excessive stacking explained above, and the alarm sequence is executed (step 203). On the other hand, if the weight sensor 36 does not detect the support arms, the stacking is identified as within the limit and the program proceeds to the next sequence.

Figure 12:
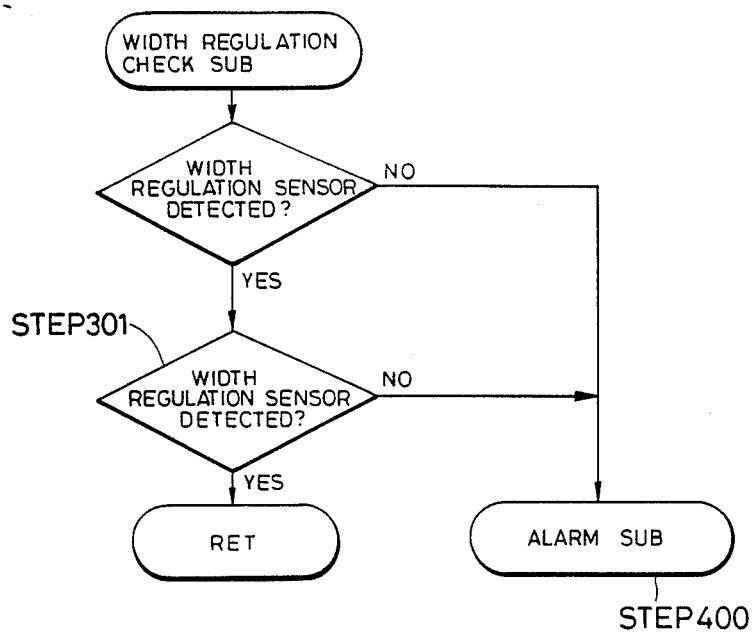

In the width defining check sequence (step 300) shown in FIG. 12, if the sensors 55 and 56 make detections, the originals are identified as being properly set and the program proceeds to the next sequence (step 301). On the other hand, if the detection is not made by at least either of said sensors, the alarm sequence is executed.

Figure 13:
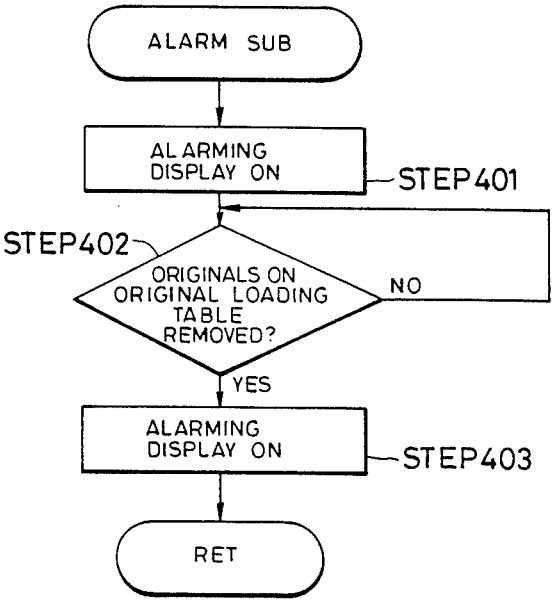

In the alarm sequence (step 400) shown in FIG. 13, in response to the detection of an abnormal state mentioned above, an alarm display is provided to inform the operator of a defective setting of the originals (step 401), since the original feeding is not yet started in this state and need not, therefore, be interrupted.

In such alarm display state, an unrepresented original sensor detects whether the originals S on the original stacker 5 are removed (step 402), and upon said removal the alarm display is turned off (step 403).

Figure 14:
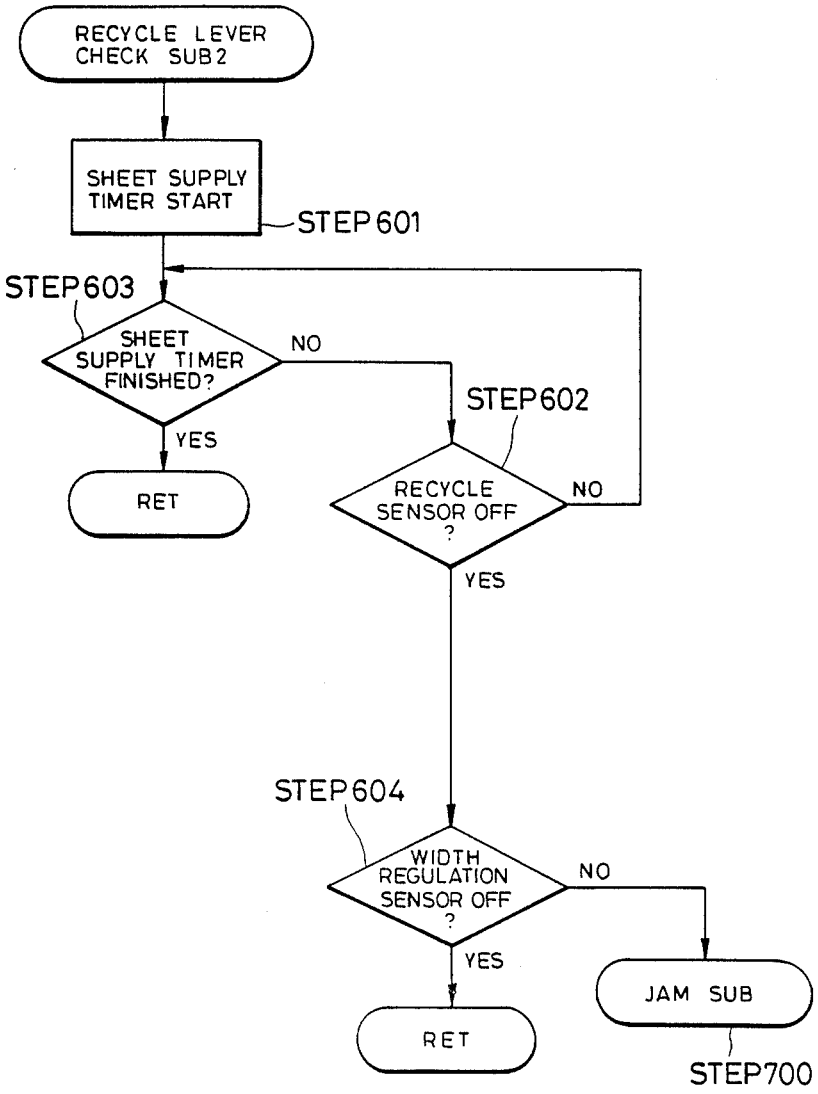

The recycle lever check sequence 2 (step 600) shown in FIG. 14 is executed immediately after the start of original feeding in the step 500. At first started is a sheet feed timer, preset at a time required by a longest original to pass through the recycle lever 6 (step 601). Until the expiration of said sheet feed timer, the state of the recycle sensor 47 is repeatedly inspected, as long as said sensor 47 is on (step 602). If the sheet feed timer expires while the recycle sensor is on, the presence of plural originals without Z-fold or severe curling is identified and the program proceeds to the next sequence (step 603). On the other hand, if the recycle sensor 47 is turned off before the expiration of the sheet feed timer, there is immediately detected the on-off state of the width defining sensor 55 (step 604). As shown in FIG. 6, said sensor 55 is in a slightly upstream position of the recycle lever 6. If the sensor 55 is off when the recycle sensor 47 is turned off, the original is identified as a usual single original without abnormal state and the program proceeds to the next sequence. On the other hand, if the sensor 55 is on when the recycle sensor 47 is turned off, it is identified that the recycle lever 6 is pushed up by a heaped portion of the original due to unsatisfactory unfolding of a Z-fold or excessive curling, thereby turning off the recycle sensor 47, and the program proceeds to the jam sequence (step 700). In this manner, in the course of feeding of an original which has been unsatisfactorily unfolded, such defect can be identified from the bounding of the recycle lever 6.

Figure 15:
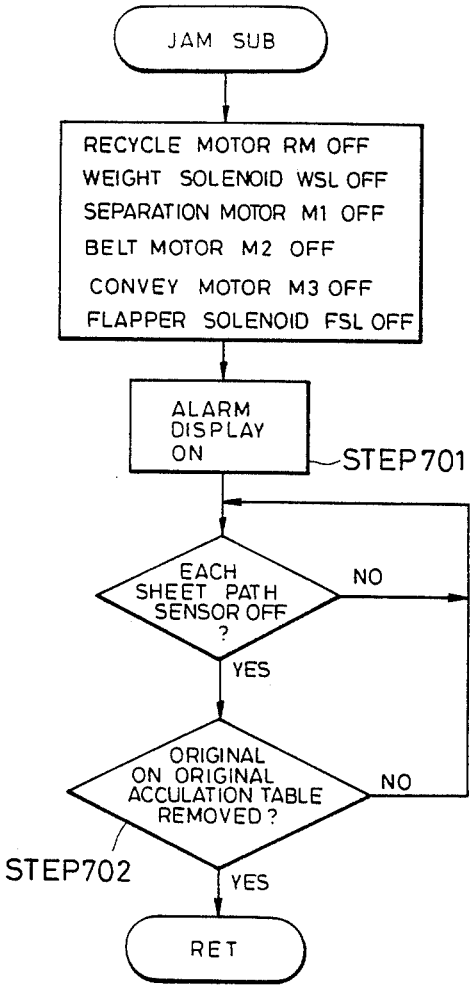

In the jam sequence (step 700) shown in FIG. 15, the operation is terminated by turning off the recycle motor (RM) 42, weight solenoid (WSL), separating motor (M1), belt motor (M2), transport motor (M3) and flapper solenoid (FSL) and the alarm display is turned on (step 701).

Then there is identified, by means of unrepresented sheet path sensors, whether the originals in the sheet paths have been removed, and, by means of an unrepresented sheet sensor positioned in the vicinity of the original inlet, whether the originals S on the stacker 5 have been once removed by the operator. If said removal has been executed, the jam halding state is cancelled (step 702).

What is claimed is:

1. An automatic original conveying apparatus for transporting original documents stacked on an original stacker unit one by one to a predetermined position, said automatic original conveying apparatus comprising:

a recycle lever member for detecting a partition in the original documents stacked on the original stacker unit;

a sensor for detecting:

(1) one circulation of the original documents by detecting passage of said recycle lever member through the original stacker unit after transportation of the original documents has started, (2) over-stacking of the original documents by detecting said recycle lever member being located in a position higher than a predetermined height, in a state where said recycle lever member is put on the original documents stacked on the original stacker unit, (3) an abnormal stacking of one of the original documents stacked on the original stacker unit, by sensing said recycle lever member plural times during a predetermined time period, and (4) deformation of one of the original documents, by detecting generation by said recycle lever means of a vertical swinging motion during transportation of the original documents; and work continuation prohibiting means for prohibiting the continuation of operation in response to the detection of abnormal stacking by said sensor.

2. An apparatus according to claim 1, further comprising detecting means for detecting presence of the original documents on the original stacker unit.

3. An apparatus according to claim 2, wherein an abnormal stacking of the original documents is a state in which vertical swinging motion of said recycle lever member is detected while the original document is present on the original stacker unit.

4. An apparatus according to claim 1, wherein said sensor comprises means for detecting whether the position of a lateral original defining member, for defining the position in width direction of the original documents stacked on the original stacker unit, is correct.

5. An apparatus according to claim 1, wherein said sensor comprises means for detecting defective fold in the original documents stacked on the original stacker unit.

6. An apparatus according to claim 2, wherein said sensor further comprises a weight member for pressing the original documents on the original stacker unit, and for detecting a position of said weight member, the position of said weight member is in accordance with the stacked amount of the original documents.

7. An apparatus according to claim 2, wherein said sensor is also constructed to detect the position of said recycle lever member after a predetermined time.

8. An apparatus according to claim 3, wherein said sensor is also constructed to detect whether the recycle lever member has passed the original stacker unit after a predetermined time.

9. An apparatus according to claim 4, wherein said sensor comprises a light emitting element and a light receiving element provided on a defining member fixed in the width direction on the original stacker unit, wherein light is transmitted diagonally between a bottom portion and a lateral portion of said defining member.

10. An apparatus according to claim 4, wherein said sensor comprises a light emitting element and a light receiving element provided on a defining member movable in the width direction on the original stacker unit, wherein light is transmitted diagonally between a bottom portion and a lateral portion of said defining member.

* * * * *